US007045492B2

(12) United States Patent
Jenevein et al.

(10) Patent No.: US 7,045,492 B2
(45) Date of Patent: May 16, 2006

(54) CLEANING COMPOSITION COMPRISING CATIONIC SURFACTANTS, CHELANT, AND AN ALCOHOL SOLVENT MIXTURE

(75) Inventors: Earl Jenevein, P.O. Box 1000, Robert, LA (US) 70455; Sharon Vercellotti, Covington, LA (US); John Vercellotti, Covington, LA (US)

(73) Assignee: Earl Jenevein, Robert, LA (US)

( * ) Notice: Subject to any disclaimer, the term of this patent is extended or adjusted under 35 U.S.C. 154(b) by 141 days.

(21) Appl. No.: 10/780,077

(22) Filed: Feb. 17, 2004

(65) Prior Publication Data

US 2004/0162230 A1 Aug. 19, 2004

Related U.S. Application Data

(63) Continuation-in-part of application No. 10/610,032, filed on Jun. 30, 2003, which is a continuation-in-part of application No. 10/351,880, filed on Jan. 27, 2003, now Pat. No. 6,720,297, which is a continuation-in-part of application No. 10/208,232, filed on Jul. 30, 2002, now Pat. No. 6,511,950.

(51) Int. Cl.
*C11D 1/62* (2006.01)
*C11D 3/48* (2006.01)

(52) U.S. Cl. ..... 510/189; 510/238; 510/241; 510/243; 510/244; 510/245; 510/254; 510/362; 510/365; 510/480; 510/504; 510/382; 510/384; 510/391

(58) Field of Classification Search ..... 510/189, 510/238, 241, 243, 244, 245, 254, 362, 365, 510/480, 504, 382, 384, 391
See application file for complete search history.

(56) References Cited

U.S. PATENT DOCUMENTS 3,755,206 A * 8/1973 Verdier ..... 510/429
3,926,910 A * 12/1975 Mowdood ..... 524/787
3,975,536 A 8/1976 Stevenson et al.
3,979,340 A * 9/1976 Klisch et al. ..... 510/429
4,451,385 A * 5/1984 Tavss et al. ..... 510/426
4,455,250 A 6/1984 Frazier
4,556,509 A 12/1985 Demangeon et al.
4,589,994 A * 5/1986 Moseman ..... 424/770
4,772,424 A * 9/1988 Greeb ..... 510/125
5,182,270 A 1/1993 Musson et al.
5,320,772 A 6/1994 Tricca
5,322,667 A 6/1994 Sherman
5,470,492 A 11/1995 Childs et al.
5,476,599 A 12/1995 Rusche et al.
5,503,756 A 4/1996 Corona, III et al.
5,578,234 A 11/1996 Corona, III et al.
5,846,988 A 12/1998 Hellberg
5,922,667 A 7/1999 Van Baggem et al.
5,929,026 A 7/1999 Childs et al.
6,048,368 A 4/2000 Tcheou et al.
6,200,990 B1 3/2001 Namil et al.
6,242,396 B1 6/2001 Guilleu et al.
6,251,844 B1 6/2001 Leonard et al.
6,436,885 B1 8/2002 Biedermann et al.
6,511,950 B1 1/2003 Jenevein
6,524,624 B1 * 2/2003 Morelli et al. ..... 424/665
6,673,761 B1 * 1/2004 Mitra et al. ..... 510/384

* cited by examiner

*Primary Examiner*—Charles Boyer
(74) *Attorney, Agent, or Firm*—Keaty Professional Law Corporation

(57) ABSTRACT

A cleaning composition for treating and removing residue containing hydrocarbons and other flammable substances uses a mixture of one or more cleaning members containing quaternary salts, a chelator and a dispersant, mixed with water. The preferred cleaning members are tetradecyltrimethylammonium bromide, tetrasodium ethylenediaminetetraacetic acid, benzethonium hydrochloride and 2-butoxyethanol. The chelator is tetrasodium salt ethylenediamine of tetraacetic acid, and the dispersant is polyvinyl alcohol. Optionally, the cleaner contains ethanol and isopropyl alcohol.

20 Claims, No Drawings

CLEANING COMPOSITION COMPRISING CATIONIC SURFACTANTS, CHELANT, AND AN ALCOHOL SOLVENT MIXTURE

CROSS-REFERENCE TO RELATED APPLICATIONS

This application is a continuation-in-part of a co-pending application Ser. No. 10/610,032, filed on Jun. 30, 2003, entitled "A Cleaning Composition for Neutralizing Biological and Chemical Weapons Removal Agents currently pending, "which is a continuation-in-part of application Ser. No. 10/351,880 filed on Jan. 27, 2003 entitled "A Cleaning Composition now U.S. Pat. No. 6,720,297," which is a continuation-in-part of application Ser. No. 10/208,232 filed on Jul. 30, 2002 entitled "A Cleaning Composition, " now U.S. Pat. No. 6,511,950 the full disclosures of which are incorporated by reference herein.

BACKGROUND OF THE INVENTION

The present invention relates to a cleaning composition and, more particularly, to a composition for use when cleaning objects containing residuals of flammable substances.

Hydrocarbons, particularly refined hydrocarbons are widely used in a large number of industries for heating, fueling, and powering structures and vehicles. With time, the motors, water heaters, boilers and the like become clogged with the oily residue that must be removed for the objects to function properly. Oil refineries and other such industrial installations often have oil spills on their property that need to be cleaned up without the added concern of self-igniting substances. Most often, the oily residue is removed using other flammable materials, thereby creating increasingly dangerous conditions.

Many refineries, aircraft industry and other technologies that handle oil and refined oil products require that the cleaner used on the equipment have no flammable substances. One of the conventional methods is to use a very caustic cleaner. However, such a cleaner may produce undesirable effects on non-metal parts of the equipment, with a potential serious damage to the equipment. There exists, therefore a need for a cleaning composition for cleaning objects that are used, or were cleaned, with flammable materials containing hydrocarbons.

The present invention contemplates provision of a cleaning composition that either totally eliminates the use of alcohol as part of the composition or uses an insignificant amount of alcohol such that the flash point of the resultant composition is relatively high to safely use in a volatile environment.

SUMMARY OF THE INVENTION

It is an object of the present invention to provide a cleaning composition that can be used for removal of contaminants containing flammable substances.

It is another object of the present invention to provide a cleaning composition that has a low flash point so as to substantially decrease the possibility of igniting the residue being removed.

It is a further object of the present invention to provide a cleaning composition that can be safely used on large areas, such as oil spills and the like.

It is still another object of the present invention to provide a method of making a cleaning composition for use in industrial and commercial environment.

These and other objects of the present invention are achieved through a provision of saturated solution of a cleaning composition, which comprises one or more quaternary ammonium salts, sulfates, chlorides or bromides. More specifically, the cleaning composition comprises tetradecyltrimethylammonium bromide, benzethonium chloride, tetrasodium ethylenediaminetetraacetic acid, polyvinyl alcohol and 2-butoxyethanol dissolved in water.

The cleaning composition of the instant invention further comprises a chelator, such as for instance edetate sodium and more specifically, tetrasodium salt (tetrasodium edetate) of ethylenediamine tetraacetic acid (EDTA). The preferred embodiment further comprises a dispersant, such as for instance polyvinyl alcohol.

The active ingredients have between about 0.97% to about 5.2% of solids and water is added to make up 100% of volume. The total concentration of the active ingredients is preferably below 50% so as to make the composition easily miscible with water.

Optionally, the composition further comprises one or more alcohols, such as ethanol and isopropyl alcohol in the combined amount of between about 2.00% and about 5.5% by volume.

DETAILED DESCRIPTION OF THE PREFERRED EMBODIMENT

The present invention concerns with a cleaning composition that may be used for removal of greasy residue in the environments, where flammable substances or traces of flammable substances are present.

The cleaning composition of the instant invention contains chlorides and bromides as the active ingredients. The bromides and chlorides are selected from the group consisting of tetradecyltrimethylammonium bromide, myristyltrimethylammonium bromide, tetrasodium ethylenediaminetetraacetic acid, benzethonium chloride, benzethonium hydrochloride, PEG-6 lauramide, stearalkonium chloride, cocoamidopropylamine oxide, cetrimonium chloride. Other suitable salts may include one or more of the following: cetamine oxide, lauramine oxide, dipalmitoylethyl hydroxyethylammonium methusulfate, elalkonium chloride, lauramine oxide, myrystamine oxide, stearamine oxide, cocamidopropyl betaine, cetyl dimethyl betaine, hydrogenated cocamidopropyl betaine, laurylamidopropyl betaine, polyglyceryl-10 decaoleate propylene, propylene glycol/dicaprylate/dicaprate, caprylic/capric triglyceride, lauramide DEA, cocamide DEA, cocamide MEA, lauramide MEA, cocamide MIPA, coco diethanolamine, butoxy ethyl stearate, distearyl phthalic acide amide, di-hydrogenated tallow phthalic acid, sodium stearyl phthalamate.

The cleaning composition of the instant invention further comprises a chelator, such as for instance edetate sodium and more specifically, tetrasodium salt (tetrasodium edetate) of ethylenediamine tetraacetic acid (EDTA). The preferred embodiment further comprises a dispersant, such as for instance polyvinyl alcohol.

The cleaning composition comprises a mixture of long-chain cation-forming organic compounds that may be found in quaternary ammonium salts. Mixtures of quaternary ammonium salts can be used. Specific examples of suitable quaternary ammonium salts are dodecyltrimethylammonium bromide (or chloride), tetradecyltrimethylammonium bromide (or chloride), hexadecyltrimethylammonium bromide (or chloride), octadecyltrimethylammonium bromide (or chloride), cetyltrimethylammonium bromide (or chloride), cetylbenzyldimethylammonium chloride, cetyltriethylammmonium bromide, and mixtures thereof.

In one of the preferred embodiments, the present invention provides for the use of tetradecyltrimethylammonium bromide, which is sold under a variety of names, for instance, Morpan T, mytab, tetradonium bromide, quaternium 13, trimethylmyristylammonium bromide. Molecular formula of tetradecyltrimethylammonium bromide is $C_{17}H_{38}BrN$. The physical data of tetradecyltrimethylammonium bromide: it is white powder with a melting point of 245–250° C. It is stable, incompatible with strong oxidizing agents, corrosive (may cause burns if handled improperly) and may damage mucous membranes. However, the preferred embodiment of the instant composition contains between about 0.05% to about 1.00% by volume of tetradecyltrimethylammonium bromide or other quaternary salt and consequently is safe.

The cleaning composition of the present invention also contains benzethonium chloride, or N,N-Dimethyl-N-[2-[2-[4-(1,1,3,3-tetramethylbutyl)phenoxy]ethoxy]ethyl]benzene-methanaminium chloride; benzyldimethyl[2-[2-(p-1,1,3,3-tetramethylbutylphenoxy)ethoxy]ethyl]ammonium chloride. This salt is very soluble in water, producing a foamy, soapy solution. It is soluble in alcohol, acetone and chloroform. It is the compound's solubility in water that became an important factor in selecting this salt for the cleaning composition of the present invention. In the preferred embodiment, the cleaning composition provides for the use of between about 0.05% to about 1.00% by volume of benzethonium chloride.

The chelator used in the cleaning composition may be edetate sodium and more specifically, tetrasodium salt (tetrasodium edetate) of ethylenediamine tetraacetic acid (EDTA). EDTA has a molecular formula of N,N-1,2-Ethanediylbin[N-(carboxymethyl)glycine]tetrasodium salt; (ethylenedinitrilo)tetroacetic acid tetrasodim salt. It is usually sold as a powder, which is readily soluble in water. The tetrasodium salt is a stable substance; if it is burned it may produce carbon monoxide, carbon dioxide or nitrogen oxides. In the preferred embodiment, the cleaning composition provides for the use of between about 0.05% to about 1.00% by volume of EDTA.

Polyvinyl alcohol that is used in the most preferred embodiment is ethanol homopolymer. Some of the polyvinyl alcohols are soluble in hot and cold water; and some require a mixture of alcohol and water for solubility. Polyvinyl alcohol is fully soluble at the pre-determined concentration of between about 0.02% to about 0.6% by volume.

The cleaner also comprises 2-Butoxyethanol in the preferred range of between about 0.08% to about 1.6% by volume. 2-Butoxyethanol is available under the names of ethylene glycol monobutyl ether, ethylene glycol butyl ether, ethylene glycol n-butyl ether, Butyl Cellosolve, butyl glycol, and butyl Oxitol and others. Its molecular formula is $C_4H_9OCH_2CH_2OH$. It is a clear colorless liquid that is used as a solvent in spray lacquers, enamels, varnishes, and latex paints and as an ingredient in paint thinners and strippers, varnish removers, and herbicides. It is also used in liquid soaps, cosmetics, industrial and household cleaners, and dry-cleaning compounds.

Optionally, the cleaner may contain one or more alcohols. This embodiment may be particularly beneficial for use where high flash point of the cleaner is not counter indicated for a particular purpose. It is believed that even with the optional alcohol, the cleaner of this invention may be used in cases where high temperatures are not anticipated. The optional alcohol may be selected from the group consisting of ethanol and isopropyl alcohol.

Ethanol (ethyl alcohol, grain alcohol) is a clear, colorless liquid. It is widely used as a fuel, as a solvent for products such as lacquers, paints, varnishes, glues, pharmaceuticals, explosives. Also as "building block" in making high-molecular-weight chemicals. Ethanol is present in the amount of between about 1% and about 2.5% by volume.

The cleaning composition of the present invention may also comprise isopropyl alcohol (IPA). Isopropyl (isopropanol) is usually produced by hydration of propylene from cracked gases. It may be obtained as by-product of certain fermentation processes. Isopropyl alcohol is often used as a solvent for oils, gums, alkaloids, resins, in the production of acetone, soap, and antiseptic solutions. Here, the cleaning composition comprises between about 1.5% and about 3.00% by volume of the IPA.

The basic cleaning composition of the preferred embodiment comprises tetradecyltrimethylammonium bromide, benzethonium chloride, tetrasodium ethylenediaminetetraacetic acid, polyvinyl alcohol and 2-butoxyethanol dissolved in water. Optionally, the composition further comprises one or more alcohol, such as ethanol and isopropyl alcohol.

In the preferred embodiment, the cleaning composition comprises equal amounts of tetradecyltrimethylammonium bromide, tetrasodium ethylenediaminetetraacetic acid, and benzethonium chloride, of between about 0.05% and about 1.00% by volume each, between about 0.02% and about 0.6% by volume of polyvinyl alcohol, and between about 0.8% and about 1.6% of 2-butoxyethanol dissolved in water. Optionally the cleaning composition further comprises between about 1.00% and about 2.5% by volume of ethanol and between about 1.5% and about 3.00% by volume of isopropyl alcohol.

The cleaner without alcohol has flash point of "0." The cleaner with additional alcohol has a flash point of about 120° F.

The preparation procedure of the cleaning composition of the present invention comprises the following steps:

a) Polyvinyl alcohol is weighed in the preferred concentration, for instance 0.06%. For 100 pounds of the final solution, polyvinyl alcohol is taken at 0.06 pounds.
b) Two pounds of water (about a quart of volume measure) are deposited in a container and heated to boiling.
c) The polyvinyl alcohol is added and the mixture is stirred until the powder is dissolved in water.
d) The resultant mixture is added to the remaining water (or 98.32 pounds). Then 1.33 pounds of 2-butoxyethanol is added and mixed with the polymer-containing aqueous solution.
e) Finally, the three salts (tetradecyltrimethylammonium bromide, tetrasodium ethylenediaminetetraacetic acid, and benzethonium chloride) are added in the amount of 0.1 pound each and the mixture is stirred until the solids are completely dissolved.

The resultant product is translucent and has no undissolved particles.

When the alcohol-containing mixture is prepared, steps a) through c) are the same as for the no-alcohol mixture described above. In step d) the remaining water constitutes 94.13 pounds. Step e) provides for the addition and mixing of 1.33 pounds of 2-butoxyethanol with the aqueous polyvinyl solution. Then 0.1 pound of each of the other three components ((tetradecyltrimethylammonium bromide, tetrasodium ethylenediaminetetraacetic acid, and benzethonium chloride) is then dissolved in 95.49 pounds of solution.

Additionally, for the alcohol-containing cleaning composition, 2.22 pounds of isopropyl alcohol and 1.96 pounds of ethyl alcohol are added to complete the final 100 pounds of the cleaner. The resultant product is translucent and has no undissolved particles.

In operation, the cleaning composition of this invention may be sprayed as an aerosol, or applied by wiping, or pouring on the surfaces that have been exposed to hydrocarbon-containing substances. The mechanism for the neutralizing of the hydrocarbon-containing residue by the formulation of the present invention is not well understood. It is believed that the key ingredients in the cleaning composition of the present invention are long chain fatty alkyl quaternary ammonium compounds. They are efficient synthetic detergents, which use the hydrophobic or non-polar "tails" of their long carbon chains to lift greasy substances from affected objects. In water, quaternary ammonium nitrogen at the end of the alkyl chain makes a polar site for anionic acid salts, proteins, and other synthetic polyanions to form an electrostatic bond as a salt. The amphipathic nature of the long chain quaternary ammonium salts also breaks the hydrogen bonded structure of water, effecting dispersion of dirt and fatty compounds in the lower surface tension of the water solvent.

The mechanism for the neutralizing of the anti-chemical and antibacterial agents that have been used in decontaminating of objects following chemical or biological attack by the formulation of the present invention is not well understood. It is believed that the key ingredients in the cleaning composition of the present invention are long chain, fatty alkyl quaternary ammonium compounds. They are efficient synthetic detergents, which use the hydrophobic or non-polar "tails" of their long carbon chains to lift greasy substances from affected objects. In water, quaternary ammonium nitrogen at the end of the alkyl chain makes a polar site for anionic acid salts, proteins, and other synthetic polyanions to form an electrostatic bond as a salt. The amphipathic nature of the long chain quaternary ammonium salts also breaks the hydrogen bonded structure of water, effecting dispersion of dirt and fatty compounds in the lower surface tension of the water solvent.

The long chain fatty quaternary ammonium ions are made of modified tallow derivatives and are resistant to dispersion in water. The cleaning composition of the present invention serves as a vehicle to promote a much greater dispersion of the lipophilic cationic surfactant (the quaternary amines) and penetration through tightly packed or polymerized dirt and stains.

Having penetrated through the surface grime and grease, the cleaning composition eventually reaches the agents that contain hydrocarbon molecules. Another component of the cleaning composition, the aminoacetic chelating agent, breaks up metal cation salts of hardened compounds. Additionally, the water soluble oxygenated polymers, which act as dispersing agents, for the entire mixture facilitate the penetration and neutralizing qualities of the cleaning composition.

The same qualities that make the cleaning composition of this invention effective in removing dirt and stains, facilitate the deep penetrating ability of the composition to remove dangerous contaminants from the surfaces and serve as an effective sanitizing agent in the event of oil spills.

It is envisioned that this cleaner may be applicable in a variety of situations, such as the decontamination of open, semi-enclosed, and enclosed facilities as well as sensitive equipment. The composition of this invention is believed to be effective in cleaning porous, non-porous surfaces, vehicles, furniture, flooring, building surfaces, and paved areas. The cleaning composition may act as a powerful bactericidal agent and used for sanitation of bathrooms, and other such facilities. It is also envisioned that the cleaning composition may be used for surface cleaning of tools and equipment where caustic cleaners cannot be applied.

The cleaning composition of this invention may act as a metal restorer and polishing material. It may be applicable to maintenance of vehicles, work areas, machinery parts that are exposed to grease, oil, sand and caked dirt. At the same time, the composition is safe, it contains biodegradable materials and is non-polluting. Hence, it may find its application in the cleanup following oil field spillage and leaks in pipelines, tanks, refineries, and oil depots.

Depending on the concentration and the active ingredients, the cleaning solution may be prepared for removing tough stains, dirt, grease, grime, protein-based stains, food stains and other stains.

The cleaning composition contains ingredients that may be easily rinsed away with water after the cleaning process has been completed. The resultant runoff is non-polluting and safe for the environment.

From the foregoing description, one skilled in the art can easily ascertain the essential characteristics of the invention defined in this specification and the appended claims, and without departing from the spirit and scope thereof can make various changes and modifications of the invention to adapt it to various usages and conditions. Such changes and modifications as would be obvious to one skilled in the art are intended to be included within the scope of the following claims.

We claim:

1. A cleaning composition, comprising:

one or more member selected from the group consisting of polyvinyl alcohol tetradecyltrimethylammonium bromide, myristyltrimethylammonium bromide, tetrasodium ethylenediaminetetraacetic acid, benzethonium chloride, benzethonium hydrochloride, PEG-6 lauramide, stearalkonium chloride, cocoamidopropylamine oxide, cetrimonium chloride, dodecyltrimethylammonium chloride, tetradecyltrimethylammonium chloride, hexadecyltrimethylammonium bromide, hexadecyltrimethylammonium chloride, octadecyltrimethylammonium bromide, octadecyltrimethylammonium chloride, cetyltrimethylammonium bromide, cetyltrimethylammonium chloride, cetylbenzyldimethylammonium chloride, cetyltriethylammmonium bromide, cetamine oxide, lauramine oxide, dipalmitoylethyl hydroxyethylammonium methanesulfonate, benzalkonium chloride, lauramine oxide, myristylamine oxide, stearamine oxide, cocoamidopropyl betaine, cetyl dimethyl betaine, hydrogenated cocoamidopropyl betaine, laurylamidopropyl betaine, polyglyceryl-10 decaoleate, propylene glycol/dicaprylate/dicaprate, caprylic/capric triglyceride, lauramide DEA, cocamide DEA, cocamide MEA, lauramide MEA, cocamide MIPA, coco diethanolamine, butoxy ethyl stearate, distearyl phthalic acid amide, dihydrogenated tallow phthalic acid, sodium stearyl phthalamate, butyl glycol, 2-butoxyethanol and mixtures thereof, a chelator and a dispersant, dissolved in water, wherein the composition comprises at least tetradecyltrimethylammonium bromide, benzethonium chloride, tetrasodium ethylenediaminetetraacetic acid, polyvinyl alcohol and 2-butoxyethanol.

2. The cleaning composition of claim 1, wherein said chelator comprises edetate sodium.

3. The cleaning composition of claim 1 wherein the tetrasodium ethylenediaminetetraacetic acid serves as the chelator.

4. The cleaning composition of claim 1 wherein the polyvinyl alcohol serves as the dispersant.

5. The cleaning composition of claim 1, further comprising at least one additional alcohol.

6. The cleaning composition of claim 5, wherein said at least one additional alcohol is selected from the group consisting of ethanol and isopropyl alcohol.

7. A cleaning composition, comprising:

one or more member selected from the group consisting of polyvinyl alcohol tetradecyltrimethylammonium bromide, myristyltrimethylammonium bromide, tetrasodium ethylenediaminetetraacetic acid, benzethonium chloride, benzethonium hydrochloride, PEG-6 lauramide, stearalkonium chloride, cocoamidopropylamine oxide, cetrimonium chloride, dodecyltrimethylammonium chloride, tetradecyltrimethylammonium chloride, hexadecyltrimethylammonium bromide, hexadecyltrimethylammonium chloride, octadecyltrimethylammonium bromide, octadecyltrimethylammonium chloride, cetyltrimethylammonium bromide, cetyltrimethylammonium chloride, cetylbenzyldimethylammonium chloride, cetyltriethylammmonium bromide, cetamine oxide, lauramine oxide, dipalmitoylethyl hydroxyethylammonium methanesulfonate, benzalkonium chloride, lauramine oxide, myrystamine oxide, stearamine oxide, cocoamidopropyl betaine, cetyl dimethyl betaine, hydrogenated cocoamidopropyl betaine, laurylamidopropyl betaine, polyglyceryl-10 decaoleate propylene, propylene glycol/dicaprylate/dicaprate, caprylic/capric triglyceride, lauramide DEA, cocamide DEA, cocamide MEA, lauramide MEA, cocamide MIPA, coco diethanolamine, butoxy ethyl stearate, distearyl phthalic acid amide, dihydrogenated tallow phthalic acid, sodium stearyl phthalamate, butyl glycol, 2-butoxyethanol and mixtures thereof, a chelator and a dispersant, dissolved in water, and wherein the cleaning composition comprises equal amounts of tetradecyltrimethylammonium bromide, tetrasodium ethylenediaminetetraacetic acid, and benzethonium hydrochloride, of between about 0.05% and about 1.00% by volume each, between about 0.02% and about 0.6% by volume of polyvinyl alcohol, and between about 0.8% and about 1.6% of 2-butoxyethanol dissolved in water.

8. The cleaning composition of claim 7, further comprising between about 1.00% and about 2.5% by volume of ethanol and between about 1.5% and about 3.00% by volume of isopropyl alcohol.

9. A cleaning composition, comprising:

effective amounts of one or more members selected from the group consisting of tetradecyltrimethylammonium bromide, myristyltrimethylammonium bromide, tetrasodium ethylenediaminetetraacetic acid, benzethonium chloride, benzethonium hydrochloride, PEG-6 lauramide, stearalkonium chloride, cocoamidopropylamine oxide, cetrimonium chloride, dodecyltrimethylammonium chloride, tetradecyltrimethylammonium chloride, hexadecyltrimethylammonium bromide, hexadecyltrimethylammonium chloride, octadecyltrimethylammonium bromide, octadecyltrimethylammonium chloride, cetyltrimethylammonium bromide, cetyitrimethylammonium chloride, cetylbenzyldimethylammonium chloride, cetyltriethylamrnmonium bromide, cetamine oxide, lauramine oxide, dipalmitoylethyl hydroxyethymmonium methanesulfonate, benzalkonium chloride, lauramine oxide, mynstylamine oxide, stearamine oxide,cocoamidopropyl betaine, cetyl dimethyl betaine, hydrogenated cocoamidopropyl betaine laurylamidopropyl betaine, polyglyceryl-10 decaoleate, propylene glycol/dicaprylate/dicaprate, caprylic/capric triglyceride, lauramide DEA, cocamide DEA, cocamide MEA, lauramide MEA, cocamide MIPA, coco diethanolamine, butoxy ethyl stearate, distearyl phthalic acid amide, dihydrogenated tallow phthalic acid, sodium stearyl phthalamate, butyl glycol and mixtures thereof, edetate sodium, between about 0.02% and about 0.6% by volume of polyvinyl alcohol, ethanol, isopropyl alcohol and, 2-butoxyethanol dissolved in water.

10. The cleaning composition of claim 9, comprising equal amounts of tetradecyltrimethylammonium bromide, tetrasodium ethylenediaminetetraacetic acid, and benzethonium chloride, of between about 0.05% and about 1.00% by volume each, between about 0.02% and about 0.6% by volume of polyvinyl alcohol, between about 0.8% and about 1.6% of 2-butoxyethanol, between about 1.00% and about 2.5% by volume of ethanol and between about 1.5% and about 3.00% by volume of isopropyl alcohol dissolved in water.

11. A method of preparing a cleaning composition comprising: a. bringing a pre-determined quantity of water to boiling, b. admixing and dissolving in boiling water a pre-determined quantity of a dispersant; c. providing a pre-determined quantity of one or more cleaning member selected from the group consisting of tetradecyltrimethylammonium bromide, myristyltrimethylammonium bromide, tetrasodium ethylenediaminetetraacetic acid, benzethonium chloride, benzethonium hydrochloride, PEG-6 lauramide, stearalkonium chloride, cocoamidopropylamine oxide, cetrimonium chloride, dodecyltrimethylammonium chloride, 2-butoxyethanol, polyvinyl alcohol tetradecyltrimethylammonium chloride, hexadecyltrimethylammonium bromide, hexadecyltrimethylammonium chloride, octadecyltrimethylammonium bromide, octadecyltrimethylammonium chloride, cetyltrimethylammonium bromide, cetyltrimethylammonium chloride, cetylbenzyldimethylammonium chloride, cetyltriethylamnimonium bromide, cetamine oxide, lauramine oxide, dipalmitoylethyl hydroxyethymmonium methanesulfonate benzalkonium chloride, lauramine oxide, myristylamine oxide, stearamine oxide, cocoamidopropyl betaine, cetyl dimethyl betaine, hydrogenated cocoamidopropyl betaine, laurylamidopropyl betaine, polyglyceryl-10 decaoleate, propylene glycol/dicaprylate/dicaprate, caprylic/capric triglyceride, lauramide DEA, cocamide DEA, cocamide MEA, lauramide MEA, cocamide MIPA, coco diethanolamine, butoxy ethyl stearate, distearyl phthalic acid amide, dihydrogenated tallow phthalic acid, sodium stearyl phthalamate, butyl glycol; d. admixing the aqueous dispersant mixture into a quantity of water sufficient to constitute 100% by volume after said one or more cleaning member is added; and e. dissolving the pre-determined quantity of said one or more cleaning member in the aqueous solution of the dispersant, and wherein said one or more cleaning member comprises a mixture of tetradecyltrimethylammonium bromide, tetrasodium ethylenediaminetetraacetic acid, benzethonium hydrochloride and 2-butoxyethanol.

12. The method of claim 11, further comprising a step of adding a pre-determined amount of chelator to the step of dissolving said one or more cleaning member.

13. The method of claim 12, wherein said chelator is edetate sodium.

14. The method of claim 11, further comprising the step of providing a pre-determined quantity of one or more alcohol selected from the group consisting of ethanol and isopropyl alcohol.

15. The method of claim 14, wherein said step of of admixing the aqueous dispersant mixture into a quantity of water sufficient to constitute 100% by volume after said one or more cleaning member is added, further comprises a step of admixing the aqueous dispersant mixture into the quantity of water sufficient to constitute 100% by volume after said one or more alcohol is added.

16. The method of claim 11 wherein the polyvinyl alcohol serves as the dispersant.

17. The method of claim 11, wherein said predetermined quantity of water brought to boiling comprises about 2% by volume of the cleaning composition.

18. The method of claim 11, wherein the content of the cleaning member is between about 0.05% and about 1% by volume.

19. A composition comprising a cleaning substance obtained by the method of claim 11.

20. A composition comprising a cleaning substance obtained by the method of claim 14.

* * * * *